US010052778B2

(12) United States Patent
Scherhag

(10) Patent No.: US 10,052,778 B2
(45) Date of Patent: Aug. 21, 2018

(54) CUTTING SYSTEM WITH CUTTING MACHINE AND AN ALIGNMENT DEVICE

(71) Applicant: ADOLF MOHR MASCHINENFABRIK GmbH & Co. KG, Hofheim am Taunus (DE)

(72) Inventor: Jurgen Scherhag, Sohren (DE)

(73) Assignee: ADOLF MOHR MASCHINENFABRIK GMBH & CO. KG, Hofheim am Tanus (DE)

( * ) Notice: Subject to any disclaimer, the term of this patent is extended or adjusted under 35 U.S.C. 154(b) by 657 days.

(21) Appl. No.: 14/396,122

(22) PCT Filed: Apr. 19, 2013

(86) PCT No.: PCT/EP2013/001162

§ 371 (c)(1),
(2) Date: Oct. 22, 2014

(87) PCT Pub. No.: WO2013/159885

PCT Pub. Date: Oct. 31, 2013

(65) Prior Publication Data

US 2015/0122098 A1 May 7, 2015

(30) Foreign Application Priority Data

Apr. 27, 2012 (EP) ..... 12166048

(51) Int. Cl.
*B26D 7/01* (2006.01)
*B26D 1/08* (2006.01)
(Continued)

(52) U.S. Cl.
CPC ..... *B26D 5/40* (2013.01); *B26D 5/00* (2013.01); *B26D 7/015* (2013.01); *B26D 1/08* (2013.01);
(Continued)

(58) Field of Classification Search
CPC ..... B26D 7/016; B26D 7/0675; B26D 7/06; B26D 7/015–7/0116; B26D 5/38–5/40;
(Continued)

(56) References Cited

U.S. PATENT DOCUMENTS 5,251,142 A * 10/1993 Cramer ..... B23D 59/008 700/171
6,327,949 B1 * 12/2001 Abernathy ..... B23D 47/04 83/452
(Continued)

FOREIGN PATENT DOCUMENTS

DE 3101911 A1 9/1982
EP 0829332 A1 3/1998
(Continued)

OTHER PUBLICATIONS

WIPO International Bureau, International Preliminary Report on Patentability for PCT/EP2013/001162 (English Translation), Oct. 28, 2014, 6 pgs., Geneva, Switzerland.

*Primary Examiner* — Laura M Lee
(74) *Attorney, Agent, or Firm* — Christopher C. Dremann, P.C.; Christopher C. Dremann

(57) ABSTRACT

The invention relates to a cutting system with a cutting machine for cutting sheet-like, stacked material and with an alignment device, which can be manually manipulated, for manually laterally aligning the material on a flat surface of the alignment device, wherein the alignment device can be placed on a table of the cutting machine, which table serves to receive the material, wherein the cutting machine has an electrical machine controller for functions of the cutting machine. In the case of a cutting system of this kind, it is provided that the alignment device has electrical components, and the electrical machine controller of the cutting machine can be actuated by means of the alignment device.

23 Claims, 7 Drawing Sheets

(51) Int. Cl.
*B26D 5/40* (2006.01)
*B26D 5/00* (2006.01)

(52) U.S. Cl.
CPC ..... *Y10T 83/2048* (2015.04); *Y10T 83/536* (2015.04); *Y10T 83/6614* (2015.04); *Y10T 83/6638* (2015.04)

(58) Field of Classification Search
CPC ..... Y10T 83/2033; Y10T 83/2046; Y10T 83/2048; B27B 27/10
USPC ..... 83/418–423, 708, 730, 743, 745, 83/435.11–435.25, 436.2, 436.8, 360–374, 83/72–76.9, 934
See application file for complete search history.

(56) References Cited

U.S. PATENT DOCUMENTS 6,601,490 B1 * 8/2003 Gross ..... B26D 7/015 83/27
7,401,416 B2 * 7/2008 Brooks ..... G01B 3/1084 33/630
7,574,949 B2 * 8/2009 Hadaway ..... B27B 27/10 83/446
8,453,549 B2 * 6/2013 Hoshor ..... B23D 45/06 192/131 R
9,808,949 B2 * 11/2017 Hori ..... B26D 5/08
2001/0000856 A1 * 5/2001 O'Banion ..... B23D 45/044 83/76.9
2002/0000145 A1 1/2002 Gottschalk
2002/0148335 A1 * 10/2002 Gross ..... B26D 7/015 83/91
2006/0102682 A1 * 5/2006 Etter ..... B23B 25/06 227/2
2008/0110309 A1 * 5/2008 Chang ..... B23D 59/00 83/62
2009/0288537 A1 * 11/2009 Hirayama ..... B26D 1/08 83/468.7

FOREIGN PATENT DOCUMENTS

EP 0972618 A2 1/2000
EP 1018408 A1 7/2000

* cited by examiner

CUTTING SYSTEM WITH CUTTING MACHINE AND AN ALIGNMENT DEVICE

CROSS REFERENCE TO RELATED APPLICATIONS

This United States national stage patent application claims the benefit of priority to International (PCT) Application No. PCT/EP2013/001162 filed on Apr. 19, 2013, which in turn claims the benefit of priority to European Patent Application No. EP 12 166 048.4 filed on Apr. 27, 2012, the entire disclosures of which are incorporated herein by reference.

FIELD OF THE INVENTION

The invention relates to a cutting system with a cutting machine for cutting sheet-like, stacked material and with an alignment device. The alignment device can be manually manipulated, for manually laterally aligning the material on a flat surface of the alignment device. The alignment device can be placed on a table of the cutting machine that serves to receive the material. The cutting machine has an electrical machine controller for functions of the cutting machine.

BACKGROUND OF THE INVENTION AND RELATED ART

A cutting system of this kind is known from practice. In the case of this cutting system, the cutting machine is in the form of a guillotine cutting machine. Said guillotine cutting machine has a basic frame which accommodates the table, and also a gantry frame which is mounted in the basic frame and in which the cutting blade and, in addition to this, a gantry frame are mounted such that they can move. Before cutting, the sheet-like, stacked material which is supported on the table is pressed against the facing surface of the table by means of the pressing bar, and cutting is then performed by means of the cutting blade. The cut partial stack has a parallelogram cross section owing to the wedge shape of the cutting blade and has to be aligned into its cuboidal shape by means of the alignment device. This is performed by the alignment device, also referred to as a knock-up block in technical terminology, being moved manually against the side surface of the cut stack by the operator of the cutting machine, said side surface being arranged at an acute angle to the cutting plane. The alignment device serves not only to return the stack of cut material which has been displaced into the shape of a parallelogram to its original cuboidal shape, but also to align the cuboidal stack against a lateral stop of the cutting machine or a backgauge for feeding the stack beneath the cutting blade for the purpose of separating the next stack.

The alignment device, which can be manually manipulated, has various designs in practice. In one embodiment, it has two plates which are arranged at a right angle in relation to one another and which form support and/or alignment surfaces which are arranged perpendicular in relation to one another. In the region of the supporting surface, the alignment device is supported on the table, and the alignment device is moved, by way of its alignment surface, against the side surface of the stack, which side surface has been displaced into the shape of a parallelogram, or against the side surface of the stack which is in cuboidal form, in order, in the case of the displacement of the stack into the shape of a parallelogram, to align said stack into its cuboidal shape, or, when the stack is in cuboidal form, to align said stack in an exactly cuboidal manner or to align said stack against the side gauge or the back gauge of the cutting machine. In an alternative design of the alignment device, it is provided that the support surface and the alignment surface are arranged at an acute angle in relation to one another, and therefore said alignment device also has the function of preventing the stack of cut material, which stack is produced during cutting and therefore is displaced into its parallelogram shape, from tipping over. This stack, which is in the form of a parallelogram, is aligned by slightly tipping the alignment device about the edge between the support surface and the alignment surface, and therefore, as a result of the support surface being slightly pivoted about this edge, such that the alignment surface is positioned in a vertical manner.

In the case of the known cutting system, the cutting machine also has an electrical machine controller for functions of the cutting machine. Said functions are, for example, cutting indication by lowering the pressing bar until it is slightly above the stack of material which is to be cut, in order to obtain a reference line for the cutting line of the blade, when said blade penetrates the stack of material which is to be cut, on account of the front contour of the pressing bar, and further setting the pressing pressure of the pressing bar, furthermore controlling the movement of the backgauge, in particular the feed speed of said backgauge. Other functions relate, for example, to those of rotating the backgauge about a vertical axis or tilting the backgauge about a horizontal axis.

A cutting system with a cutting machine for cutting sheet-like, stacked material and with an alignment device, which can be manually manipulated, for manually laterally aligning the material against a flat surface of the alignment device, wherein the alignment device can be placed on a table of the cutting machine, is known, for example, from DE 31 01 911 A1.

EP 1 018 408 A1 describes a cutting system which has a cutting machine for cutting sheet-like, stacked material and an alignment device for laterally aligning the material against a flat surface of the alignment device. Although the alignment device can be manually manipulated in said document in order to position said alignment device in a specific position on the table, and to fix said alignment device there, the material is aligned by machine in the case of this alignment device.

OBJECT AND SUMMARY OF THE INVENTION

The object of the invention is to develop a cutting system of the kind described in the introductory part such that it is significantly easier for an operator of the cutting machine to work with the cutting machine, in particular in respect of operability and ergonomic working.

In the case of a cutting system of the kind described in the introductory part, the object is achieved in that the alignment device has electrical components, and the electrical machine controller of the cutting machine can be actuated by means of the alignment device.

This cutting system therefore allows the operator to activate specific functions of the cutting machine by means of the alignment device, so that it is not necessary for the operator to activate said functions directly on the cutting machine. This is of particular advantage in this respect because specific functions of the cutting machine can be activated significantly better from outside. According to the cutting system according to the invention, this is performed by means of the alignment device which has the electrical components which are required for this purpose.

The electrical machine controller of the cutting machine can preferably be actuated in a wireless manner by means of the alignment device. Accordingly, the alignment device can be manipulated in any desired manner in order to align the sheet-like, stacked material on the table, without having to take into consideration cabling between the alignment device and the cutting machine. Actuation of the electrical machine controller of the cutting machine in a wireless manner is performed, in particular, by radio.

The cutting machine usually has operator control elements and indicators which are associated with the machine controller of the cutting machine. In respect of a preferred development of the cutting system according to the invention, it is provided that the alignment device has operator control elements and/or indicators which are associated with the machine controller of the cutting machine. Defined functions of the cutting machine can be activated by means of the operator control elements of the alignment device. Indicators of the alignment device can transmit information about the selected function of the cutting machine or, in general, basic functions or states of the cutting machine to the operator of the cutting system, specifically to the operator holding and therefore moving the alignment device.

It is considered to be particularly advantageous when the operator control elements and indicators of the cutting machine and/or alignment device are integrated into a touchscreen display. Accordingly, the alignment device in particular can be controlled by means of the touchscreen, and information can be displayed on the touchscreen, for example information relating to activated functions or, in principle, functions which can be selected by means of the alignment device.

It is considered to be particularly expedient when the cutting machine has a transmitter and receiver which are associated with the machine controller of said cutting machine, and the alignment device has a transmitter and receiver which are associated with the electrical components of said alignment device, wherein firstly the transmitter of the cutting machine and the receiver of the alignment device interact, and secondly the transmitter of the alignment device and the receiver of the cutting machine interact.

An indicator of the alignment device, in particular a display of the alignment device, is preferably connected to the receiver of the alignment device.

The alignment device can be provided with a large number of input components. For example, the alignment device therefore has a keypad, a touchscreen, a connection for a mobile data memory, and/or a scanning device. The scanning device is provided, for example, in order to read data, which, in conjunction with the cutting program of the cutting machine and therefore the manipulation of the material which is to be cut by the operator, is of particular importance, into the alignment device in the manner of a barcode scanner. The data which is read-in by means of the scanning device is found, for example, in a specific job card or is printed onto the topmost sheet of the stack of material which is to be cut, so that it is only necessary to move the alignment device over the stack in this region. The connection for the mobile data memory is provided, in particular, in order to read data, for example updated software for the alignment device or the cutting system, into the alignment device by means of the mobile data memory which is connected to the connection. The touchscreen serves for commands or signals to be easily input by the operator and, moreover, for displaying cutting system-, product- or processing sequence-related data. This data can also be input using the keypad.

It is therefore considered to be preferred when data which is input or read-in by means of the keypad, the touchscreen, the data memory and/or the scanning device can be displayed on the indicator of the alignment device and/or can be transmitted, in particular can be transmitted in a wireless manner, to the machine controller of the cutting machine.

The alignment device can, for example, also be provided with an access barrier, in particular an electronic access barrier. Activation of one, several or all of the electrical functions of the alignment device can be blocked by means of the access barrier. The access barrier can be a password-protected access barrier.

The alignment device is physically designed, in particular, in such a way that it has a first part with a lower flat surface, a second part which is arranged perpendicular to said first part and has a flat surface which is arranged perpendicular to the lower flat surface, and a third part which connects the two parts. The lower flat surface and/or the flat surface which is arranged perpendicular to the lower flat surface are/is, in particular, of rectangular design. These two flat surfaces preferably make contact in the region of an edge. The third part preferably has a grip recess for manually grasping the device. The two flat surfaces of the first and the second part are arranged, in particular, at a right angle in relation to one another.

An alignment device which is designed in this way can be grasped particularly well and easily manipulated by the operator, that is to say in particular lifted, positioned on the table surface and moved on said table surface in order to align the stacked, sheet-like material.

It is considered to be particularly advantageous when operator control elements of the alignment device are arranged in the region of the third part. The operator control elements are therefore arranged in a region of the alignment device in which said alignment device is grasped by the hand of the operator. The operator who has grasped the alignment device can at the same time operate the operator control elements with one or more fingers of the gripping hand, and therefore actuate or select functions of the cutting machine.

It is considered to be particularly advantageous when a backgauge of the cutting machine for feeding the material, which is to be cut, in the direction of the cutting plane of the cutting machine can be actuated by means of one or more operating elements of the alignment device. This actuation process is performed, in particular, for the purpose of moving the back gauge perpendicular to the cutting plane, in order to therefore move the material, which is to be cut, into a position beneath the cutting blade, further for rotating the backgauge about a vertical axis, in order to thereby compensate for any existing inaccuracies, in particular in relation to the cuboidal design of the material which is to be cut, and to ensure that the material is separated exactly in the region of a cutting line which is prespecified by cutting marks, further to be able to tilt the backgauge about a horizontal axis, in order to in this way be able to compensate for irregularities in the stack of material, which is to be cut, over the height of said stack, so that cutting can be performed in the exact cutting plane once again.

Since the operator control elements for these functions are located on the alignment device, the operator can, while acting, for example, on the front side surface of the stack of material which is to be cut in order to push said stack back against the backgauge, actuate the backgauge by adjusting the backgauge about its vertical axis. The operator accordingly does not have to call up the corresponding function, without visual inspection of the stack which is to be cut, on the cutting machine. This is significantly more ergonomic for the operator and, moreover, also more suitable for the processing sequence in respect of cutting the material which is to be cut.

This correspondingly applies for the operating state of the cutting machine according to which the pressing bar can be moved by actuation into a cutting indication position and/or the pressing pressure of the pressing bar can be set. The operator can likewise effect this by operating one or more operator control elements on the alignment device. Therefore, it is provided that the pressing bar of the cutting machine, which pressing bar serves to clamp the material which is to be cut between said pressing bar and the table, can be moved by actuation into a cutting indication position and/or can be set in respect of its pressing pressure by means of one or more operator control elements of the alignment device.

The alignment device can have, for all intents and purposes, further electrical components which are independent of the cutting machine. For example, measuring means can be integrated into the alignment device. These measuring means are preferably provided in order to measure a movement alignment device, which is supported on the table of the cutting machine, relative to the table. If the alignment device is supported on the table and, in the process, bears against a cuboidal stack of sheet material, and this stack bears against the backgauge on the opposite side, the measuring means of the alignment device can be used to check whether the measured feed path of the backgauge, which feed path is usually displayed on an indicator of the cutting machine, coincides exactly with the movement path of the alignment device which is measured by means of the alignment device. The measuring means of the alignment device could also be designed such that it serves to ascertain a horizontal distance, in particular a variable horizontal distance, of the alignment device, which is supported on the table of the cutting machine, from a region of the cutting machine. Accordingly, the distance of the alignment device, for example, from the backgauge or a side gauge can be measured by this measuring means. The measuring means may well also be measuring means for ascertaining forces, for example force-absorbing means for recording a force which is caused by rotation or tilting of the backgauge. In this case, the alignment device bears, for example, against a stack, and the stack bears against the backgauge on that side which is averted from the alignment device, wherein, when the function of rotation or tilting of the backgauge is operated by the operator, the measuring means of the alignment device records the force which is exerted on the stack by the rotation or tilting of the backgauge in respect of the change in force.

Further features of the invention are presented in the description of the following drawing figures, the detailed description of embodiments of the invention, and in the appended claims.

BRIEF DESCRIPTION OF THE DRAWING FIGURES

The cutting system according to the invention is illustrated in the accompanying drawing figures on the basis of several preferred embodiments, without being restricted to said embodiments.

DETAILED DESCRIPTION OF THE EXEMPLARY EMBODIMENTS OF THE INVENTION

Figure 1:
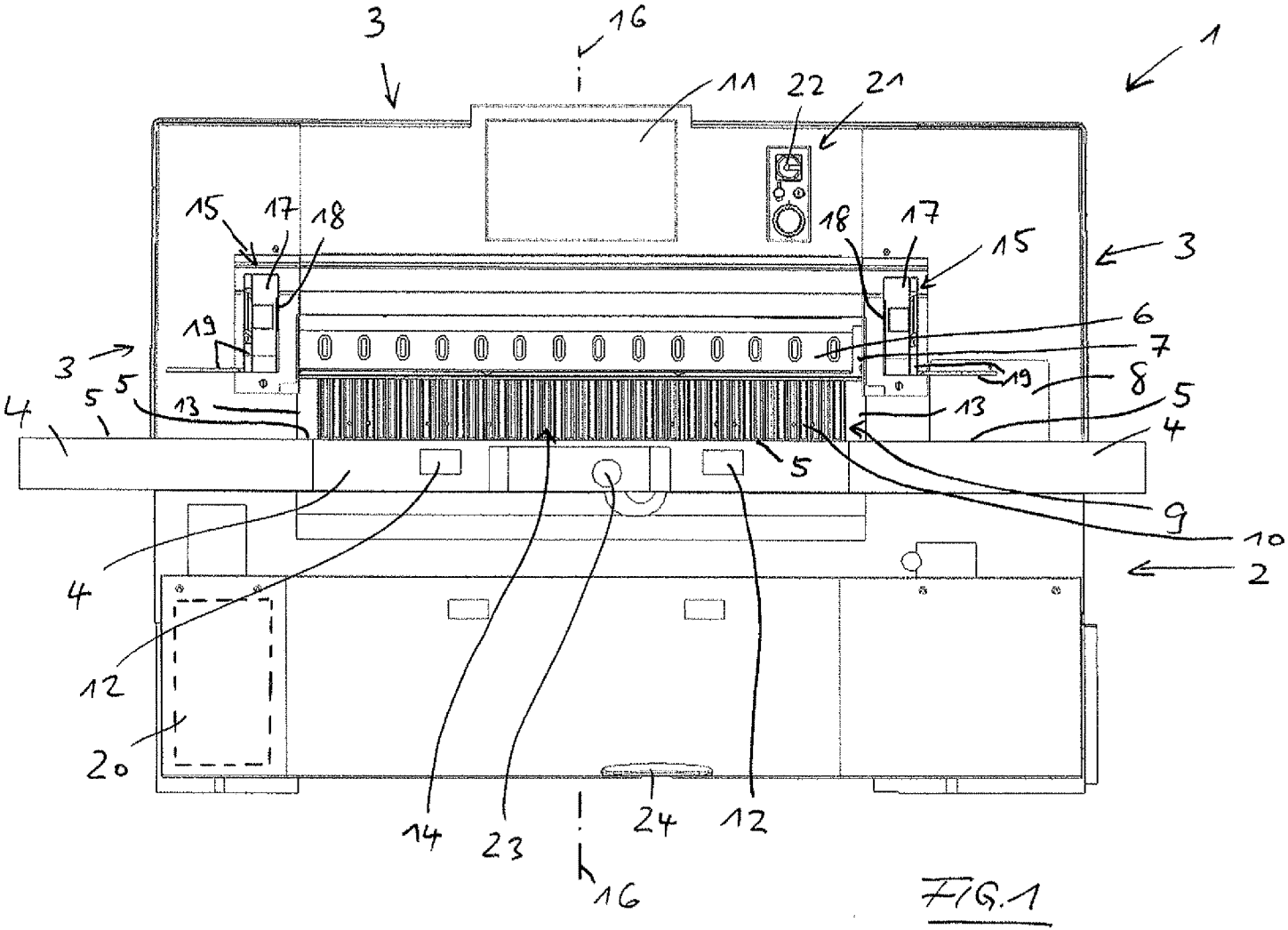
FIG. 1 shows a front view of an exemplary embodiment of a cutting machine which is used in the cutting system according to the invention.

The cutting machine 1, which is shown in FIG. 1 and is in the form of a guillotine cutting machine, serves to cut stacked, sheet material, in particular such material which is composed of paper, board, foil or the like, which is in cuboidal form. The cutting machine has a stand 2 with an upper gantry frame 3, and also a table 4. The table 4 is provided with an upper, horizontal table surface which serves to receive the stack, be it a stack of material which is to be cut or a stack of cut material, the latter also being referred to as a stack of sheets. The table surface 5 therefore extends perpendicular to the plane of the drawing sheet. A cutting blade 6 which can be lowered and raised is mounted in the gantry frame 3, and a pressing bar 7 which can likewise be lifted and lowered in the gantry frame 3 is mounted behind said cutting blade. The pressing bar 7 serves to fix the material which is to be cut, by the pressing bar 7 pressing the stack of material which is to be cut against the table 4 in the lowered position. The cutting blade 6 can be moved from the upper end position, which is illustrated in FIG. 1, to a lower end position, in which it enters a cutting strip which is made in the table 4, during swinging cutting by means of a crank drive. The pressing bar 7 can be lowered from the raised position, which is illustrated in FIG. 1, to the lowered position, in which it rests on the stack, by means of a drive. In the raised position of the blade 6 and pressing bar 7, the pressing bar 7 extends somewhat below the level of the blade 6, and therefore the blade edge is not exposed. The drive motor for the cutting blade 6 is arranged in the right-hand-side region of the gantry frame 3 and is accessible through a flap 8 which closes an opening in the gantry frame 3. A feed device is provided in the region of the rear table part, the said feed device having a backgauge 9 which is designed in a known manner and has a front rake section 10 which serves to feed the stack, which is to be cut, in the direction of the operator, perpendicular to the cutting plane. That side of the backgauge 9 which faces the operator runs parallel to the cutting plane of the cutting blade 6. The backgauge 10 can be moved forward and backward in the region of the rear table part. In the upper, horizontally running section of the gantry frame 3, said gantry frame is provided with an operator control and information display 11 which is a touchscreen. The cutting machine 1 is operated with two hands by two operator control keys 12 being provided in the front region of the table 4, at a distance from one another. This ensures, in principle, that the operator, when operating the cutting machine 1 and therefore initiating cutting, cannot reach into the region of the cutting blade 6 with his hands. The cutting machine is further provided with side stops 13 in the region of the two sides in order to position the material to be cut against one or other stop.

Beneath the cutting blade 6 and the pressing bar 7 which are located in raised positions, an opening 14 is formed in the gantry frame between said cutting blade and pressing bar and the table surface 5. The maximum dimensions of the material, which is to be cut, in respect of width and height is limited by said opening 14. Arrangements 15 which, given the same starting position, are arranged symmetrically to a central plane 16 which is arranged perpendicular to the cutting plane, therefore perpendicular to the drawing sheet, are located to the side of the region of the table 4 which faces the operator, that is to say to the side of the opening 14. The respective arrangement 15 is formed substantially by a light barrier housing 17, light barriers 18 which are accommodated by said light barrier housing, and a cover element 19. The light barriers 18 of the two arrangements 15 serve to guard the space in front of the cutting blade, and the respective cover element 19 can be pivoted from the position which is illustrated in the drawing figures to an end position in respect of the associated light barrier housing 17 in which the light beams or light signals from the light barriers 18 are interrupted. This is important particularly for the arrangement 15 which is illustrated on the right-hand side if, after the cover element 19 is pivoted into the light beams from the light barriers, the flap 8 of the gantry crane 3 is opened and servicing work can be performed on the cutting machine 1, in particular on the drive of the cutting blade 6.

An electrical machine controller 20 for the functions of the guillotine cutting machine 1 is arranged behind a cover in the stand 2 of the guillotine cutting machine 1. Said machine controller 20 is shown by a region which is illustrated using dashed lines.

Both the operator control and information display 11, and also, in addition to this, an operator control unit 21 which has, in particular, an on/off switch 22 for switching on and switching off the guillotine cutting machine 1, is arranged on that side of the gantry frame 3 which faces the operator. The table 4 has, on its side which faces the operator, in the center of the table 4, a hand wheel 23 which allows the backgauge 9 to be slowly moved forward or backward by rotation by means of a rotary potentiometer, which interacts with the electrical machine controller 20, when the material which is to be cut is intended to be positioned exactly with respect to the cutting plane of the cutting blade 6 manually by means of the backgauge 9. Furthermore, the guillotine cutting machine 1 has a centrally arranged foot pedal 24 in the region of the front side of the stand 2 in the region of the lower end of said stand. The operator of the cutting machine 1 can move the pressing bar 7 into a cutting indication position by operating said foot pedal 24, the pressing bar being positioned at a short distance above the stack, which is to be cut, in the cutting indication position and therefore it being possible to align cutting markings on the topmost sheet of the stack with respect to a cutting indication line of the pressing bar 7 exactly by means of the operator manipulating the stack. The stack is generally manipulated in this way by the operator grasping the stack with both hands or acting on the sides of the stack by means of one or two alignment devices.

Figure 2:
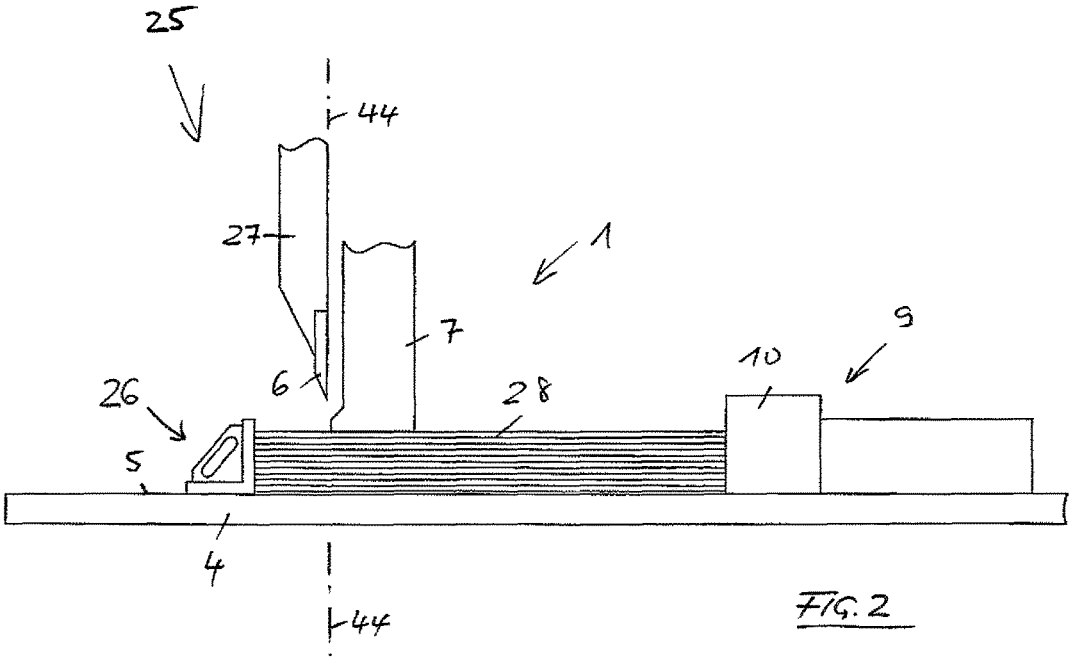
FIG. 2 shows the cutting system, comprising the cutting machine, which is illustrated only in principle in respect of essential components, and an alignment device which can be manually manipulated, shown as seen from the side, horizontally, in the direction of the cutting plane.

FIG. 2 shows, in a highly simplified manner, the cutting system 25 according to the invention comprising the above-described cutting machine 1, which is illustrated in an only very simplified manner in FIG. 2, and an alignment device 26 which can be manually manipulated and is manipulated by the operator. Said FIG. 2 shows that the cutting blade 6 is held in a blade holder 27 which constitutes the actual mounting of the cutting blade 6 in the gantry frame 3. The cutting blade 6 is of wedge-like design, and therefore, when the shown overall stack 28 is cut, a partial stack which is displaced into the shape of a parallelogram is separated. FIG. 2 shows the stack 28 in its position in which it is fed beneath the cutting blade 6 by means of the backgauge 9 with the stack 28 being pressed by the pressing bar 7, before cutting is executed.

Figure 4:
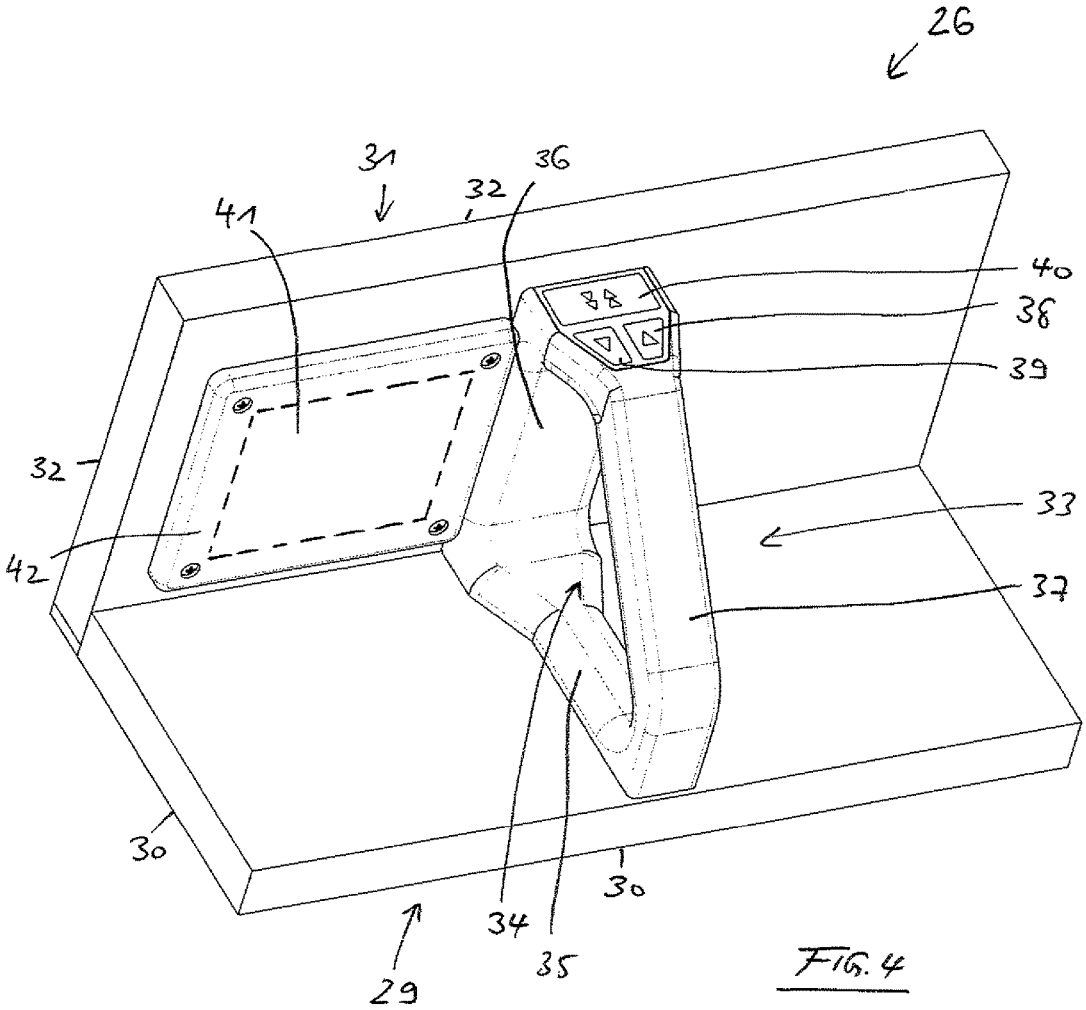
FIG. 4 shows a first exemplary embodiment of the alignment device which is used in the cutting system, shown in a three-dimensional illustration.

A first exemplary embodiment of the alignment device 26 is shown in FIG. 4. The alignment device 26 has a first cuboidal plate 29 with a lower flat surface 30 and a second, likewise cuboidal plate 31 which is arranged perpendicular to said plate 29 and has, on that side which is averted from the plate 29, a flat surface 32 which is arranged perpendicular to the surface 30. The surface 30 constitutes a support surface, it being possible for the alignment device 26 to be placed onto the table surface 5 of the table 4 in the region of said support surface. The surface 32 of the alignment device 26 constitutes an alignment surface, the alignment device 26 making contact with the material, which is to be cut, in the region of said alignment surface for alignment purposes. Heating plates 29 and 31 have the same length and a grip part 33 is connected to the two plates 29 and 31 approximately halfway along the length of the respective plates 29 and 31, said grip part having a grip recess 34. The grip part 33 is in the form of a triangular body which exhibits the grip recess 34, wherein the two limbs 35, 36 of the grip part 33, which form a right angle with one another, are connected to the plates 29 and 31. A web 37 of the grip part 33 connects the ends of the two limbs 35 and 36 which are averted from one another. The alignment device 36 is grasped by a hand of the operator in the region of said web 37. The associated ends of limb 36 and web 37 have operator control elements 38, 39 and 40 at the transition from the webs 37 to the limb 36. The operator control element 38 serves to control the function of advancing the backgauge, that is the movement of the backgauge 9 forward in the direction of the cutting plane. The operator control element 39 is intended for controlling the function of returning the backgauge. The operator control element 40 can be used to change the speed at which the backgauge is advanced and returned. If the operator control element 40 is moved, for example, to a switching position which causes the backgauge to move quickly, subsequently pressing the operator control element 38 leads to the backgauge being advanced quickly, and pressing the operator control element 39 leads to the backgauge being returned quickly. If the operator control element 40 is in the other switching position, pressing the operator control element 38 causes the backgauge to advance slowly, and pressing the operator control element 39 causes the backgauge to return slowly.

The operator control elements 38, 39 and 40 interact electrically with further electrical components of the alignment device 26, specifically an electrical controller which interacts with the electrical machine controller 20 of the cutting machine 1. Said electrical controller, which is illustrated using dashed lines and denoted by reference numeral 41 in FIG. 4, is integrated into a hollow space in the plate 31, which hollow space is open toward the grip part 33, and closes said hollow space by means of a cover 42.

Figure 5:
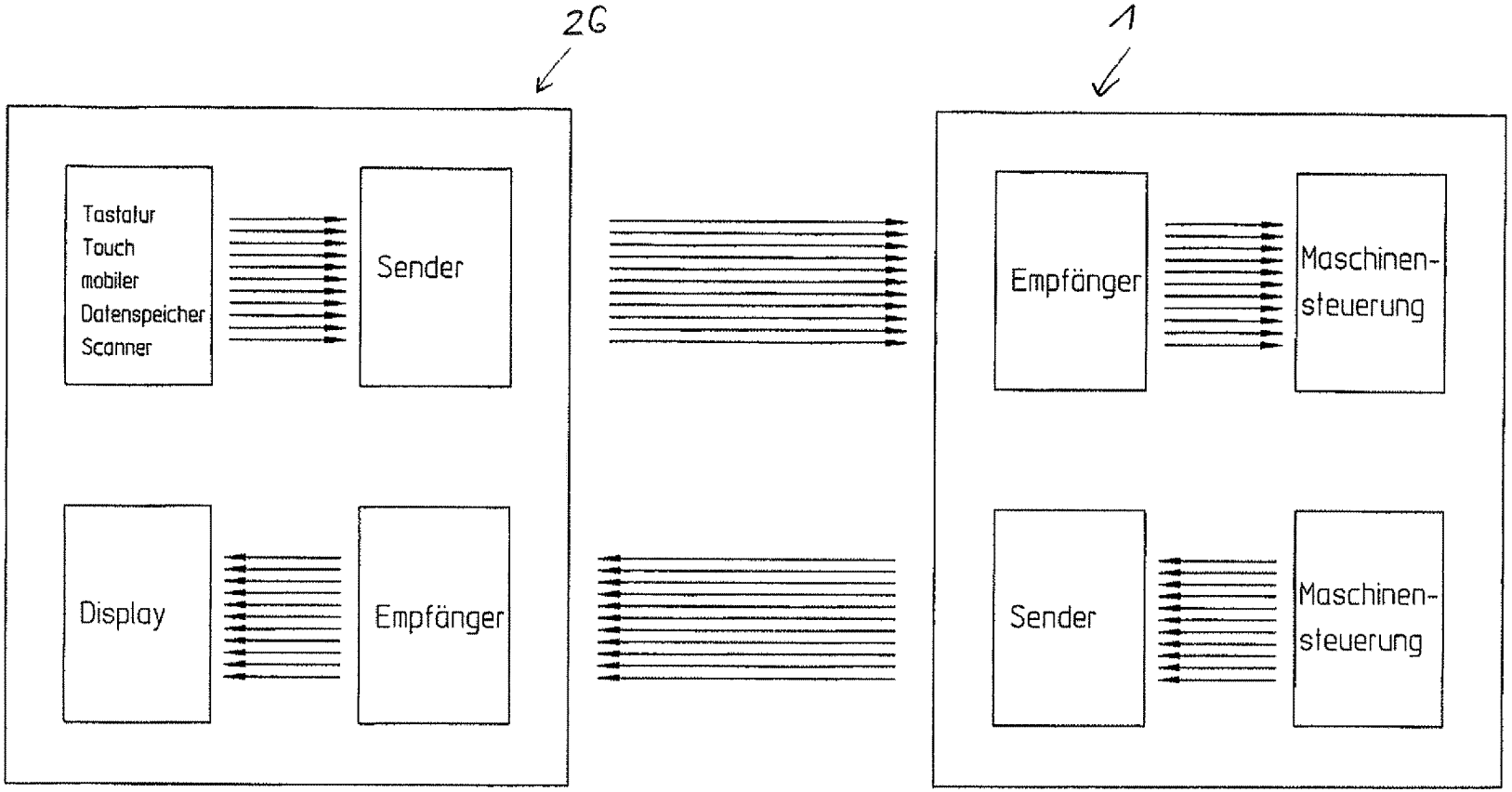
FIG. 5 shows a basic illustration of the essential electrical components of the cutting machine and alignment device.

FIG. 5 illustrates the fundamental design of the cutting machine 1 and alignment device 26 in respect of the control-related interaction of said cutting machine and alignment device:

The cutting machine 1 has a transmitter and receiver which are associated with the machine controller of said cutting machine, and the alignment device 26 has a transmitter and receiver which are associated with the electrical components of said alignment device. Firstly, the transmitter of the cutting machine 1 and the receiver of the alignment device 26 interact, and secondly the transmitter of the alignment device 26 and the receiver of the cutting machine 1 interact. The data which is received by the receiver of the alignment device 26 can be displayed on a display of the alignment device 26. Data or commands can be input or read into the operator control unit 21 by means of a keypad, a touchscreen, a mobile data memory or a scanner, and are transmitted to the receiver of the cutting machine 1 by means of the transmitter of the alignment device 26. In principle, it would also be entirely possible to process said data internally in the alignment device 26 and, in particular, to display said data or processed data on the display of the alignment device 26. This is the case particularly when the alignment device 26 is used independently of the cutting machine 1.

In principle, the alignment device 26 can be provided with an access barrier, in particular an electronic access barrier, wherein activation of one, several or all of the electrical functions of the alignment device 26 can be blocked by means of the access barrier.

The manner of operation of the alignment device 26 according to the exemplary embodiment of FIG. 4 will be explained below with reference to the illustrations in FIGS. 2 and 3:

The operator can use said alignment device 26 to influence the movement of the backgauge 9 when manipulating the alignment device 26.

If, in contrast to the illustration according to FIG. 2, the pressing bar 7 is in its raised position, the operator can, when the controller of the alignment device 26 is activated, avoid creating the exact movement of the backgauge 9 by turning the hand wheel 23 of the cutting machine 1, but rather said operator is able to effect this by operating the operator control elements 38 to 40 of the alignment device 26. During this procedure, the operator can look at the stack and, in the process, control the alignment device 26 in such a way that approximate, rapid advance of the backgauge 9 is initiated initially by controlling the operator control element 40, and then the rapid forward movement is performed by operating the operator control element 38, with the alignment device 26, which is supported on the table 4 and possibly is manipulated by the operator, as illustrated in respect of FIG. 2 and in respect of FIG. 3, bearing flat against the stack 28 on that side of said stack which is averted from the rake section 10. If the cutting marking on the top sheet of the stack is at a relatively short distance from the cutting plane, the operator releases the operator control element 38 and presses the operator control element 40 in order to switch said operator control element for slow movement. When the operator control element 38 is subsequently pressed again, the backgauge 9 will move further forward at a low speed, until the operator releases the operator control element 38 when the desired position is reached.

Figure 3:
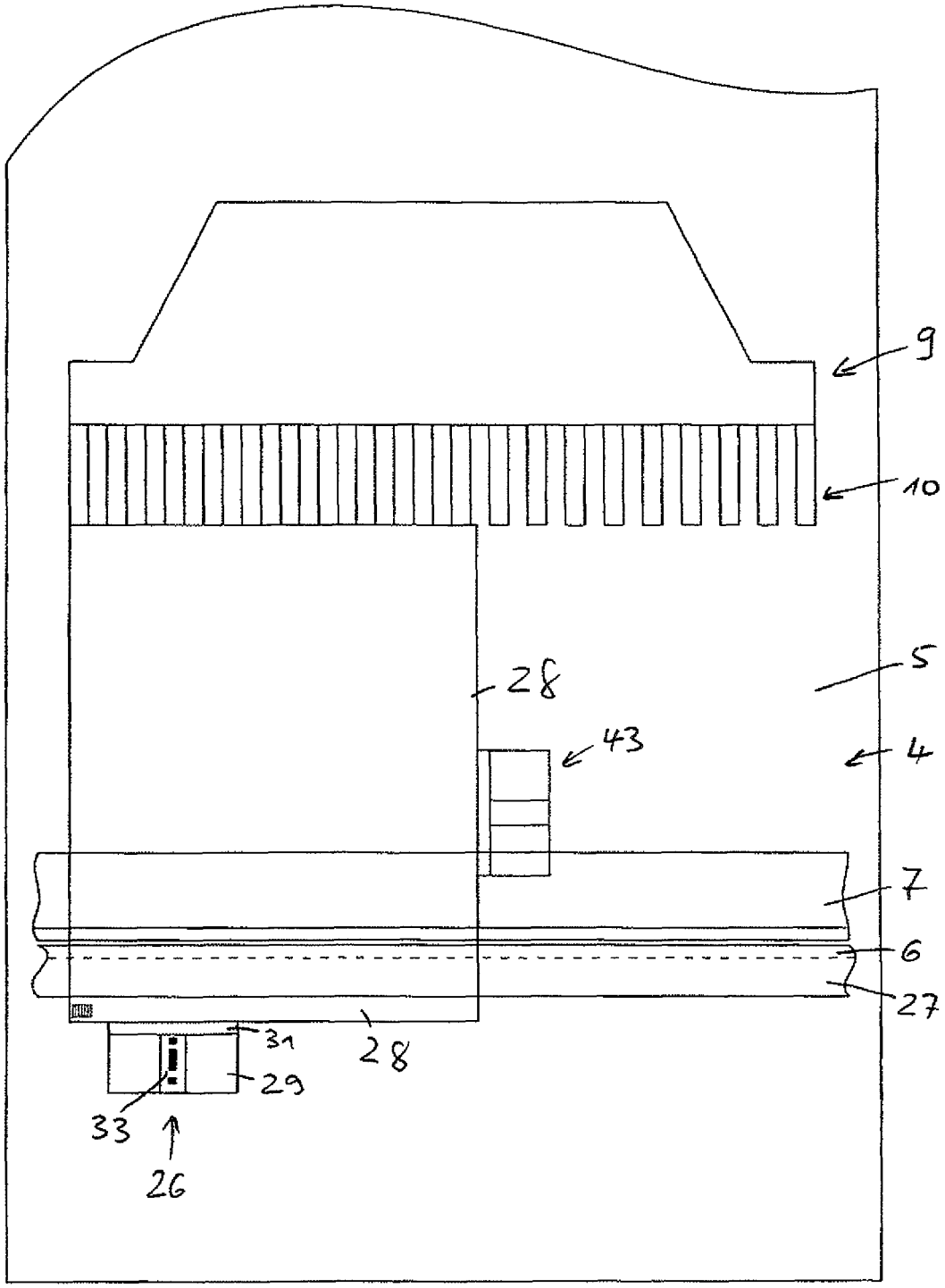
FIG. 3 shows the arrangement according to FIG. 2 as seen in a plan view perpendicular to the surface of the table of the cutting machine.

Since the operator does not have to hold the cutting machine 1 in this portion of the method, he can, for all intents and purposes, as illustrated in respect of FIG. 3, use one hand to move the alignment device 26, which is provided according to the invention and which has the electrical components, and use the other hand to move a conventional alignment device 26 which then serves to align the material, and therefore has no electrical components. This allows, with two-handed operation, both the cutting machine 1 to be actuated by means of the alignment device 26 and also the stack to also be aligned on two adjoining sides by means of the alignment device 26 and the conventional guide gauge 43.

The dotted-and-dashed line in FIG. 2, which is denoted by the reference numeral 44, shows the cutting plane of the cutting blade 6, as seen perpendicular to the plane of the drawing sheet.

In FIG. 3, the topmost sheet of the stack 28 is provided on its front, left-hand side with a printed barcode 45 which can be evaluated by means of a barcode scanner of the alignment device 26. Data which is evaluated by the scanner can be displayed either on a display of the alignment device 26 or on the operator control and information display 11 of the cutting machine 1, or even processed by the machine controller for automated processing of the stack 28.

Figure 6:
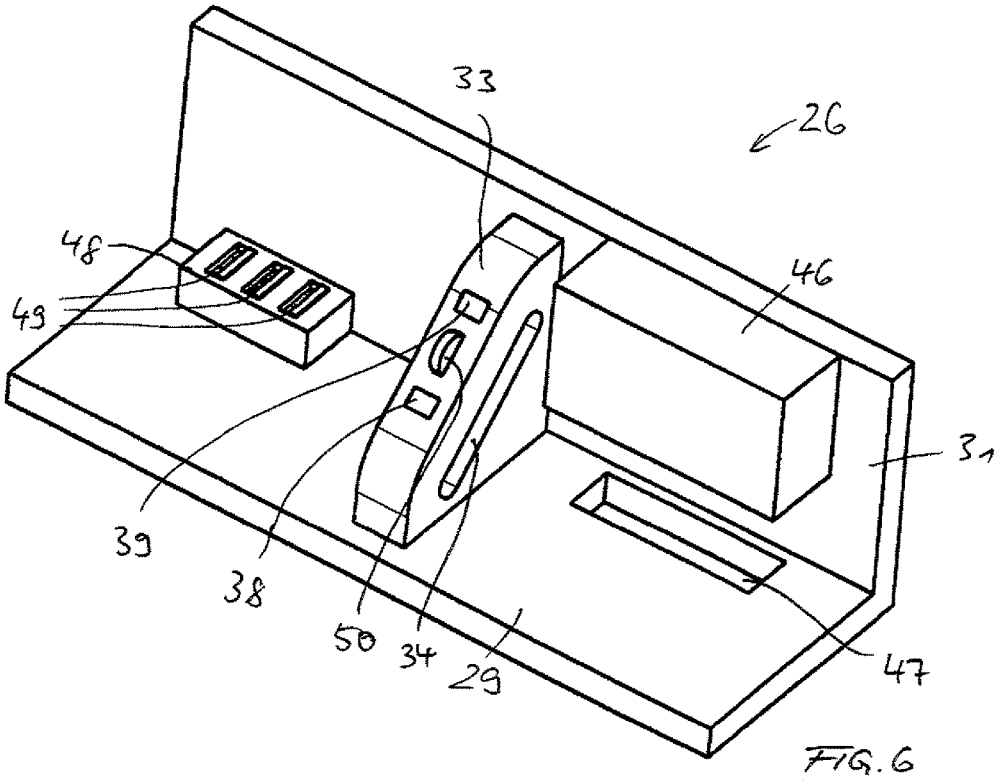
FIG. 6 shows a second exemplary embodiment of an alignment device according to the invention, shown in a three-dimensional illustration.
Figure 7:
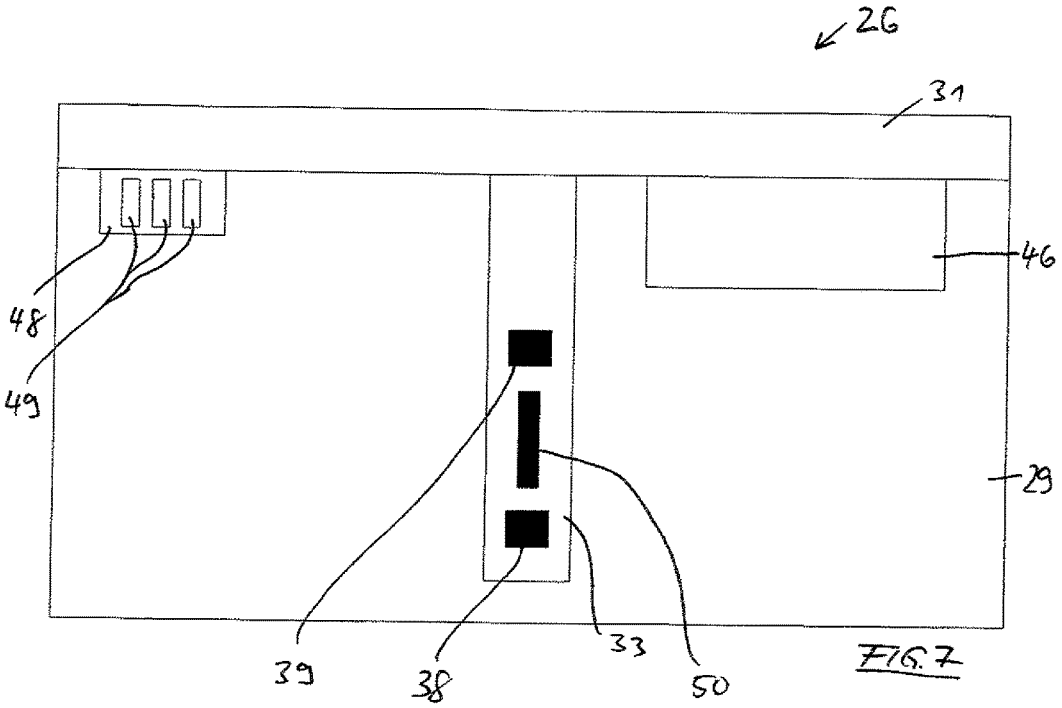
FIG. 7 shows the alignment device according to FIG. 6, as seen from above.

FIGS. 6 and 7 show a second exemplary embodiment of the alignment device 26. Said alignment device is designed substantially in accordance with the exemplary embodiment according to FIG. 4 in respect of the plates 29, 31 and the grip part 33. The alignment device 26 according to FIGS. 6 and 7 exhibits, on one side of the alignment device 26, next to the grip part 23, a box 46 in which not only the electronic controller 41 of the alignment device 26 but also a barcode scanner are accommodated, it being possible for the scanner beam from said barcode scanner to pass through a rectangular passage opening 47 in the plate 29. On the other side of the grip part 33, a connection 48 with three sockets 49 for inserting mobile data memories is provided with the plate 29. Measurement data or else software updates relating to the alignment device 26 which has the electronic components is/are stored on said data memories, for example.

Two operator control elements 38 and 39 for advancing and returning the backgauge 9 are arranged in the grip part, and furthermore an actuating wheel 50 is arranged between these two operator control elements 38, 39, wherein said actuating wheel is connected to electrical components of the electrical controller 41 in such a way that a movement speed of the backgauge 9 can be varied, taking into account the operation, by the operator control elements 38 and 39, by virtue of large or smaller rotation angles of the actuating wheel 50.

Figure 8:
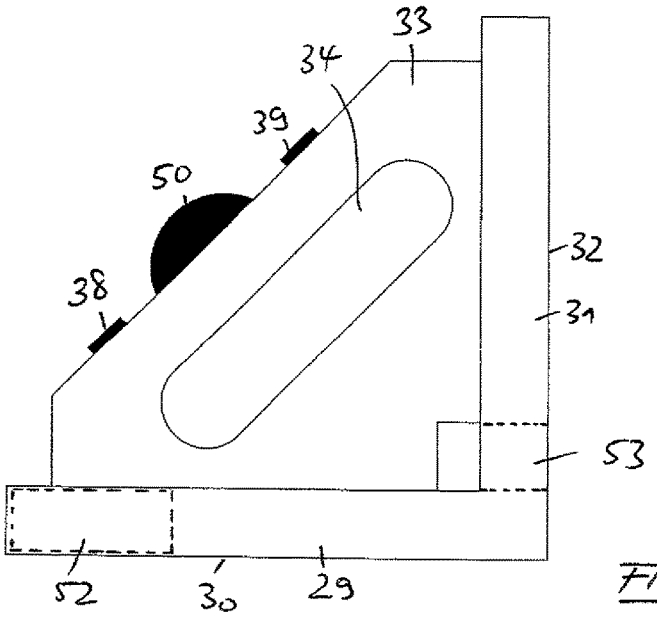
FIG. 8 shows a third exemplary embodiment of an alignment device according to the invention, as seen from the side.
Figure 9:
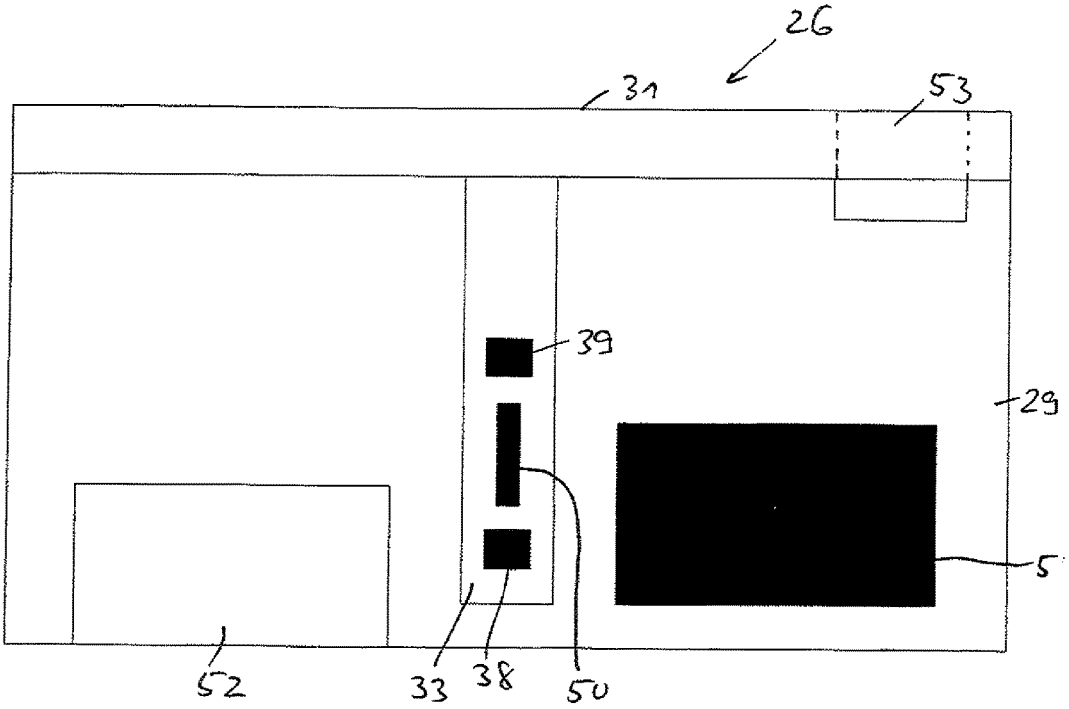
FIG. 9 shows the alignment device according to FIG. 8, as seen from above.

The third exemplary embodiment according to FIGS. 8 and 9 differs from the basic design of the alignment device 26 according to FIGS. 6 and 7 in respect of plate 29, plate 31, part 33 with grip recess 34, and also the operator control elements 38, 39 and the actuating wheel 50 in that the plate 29 has a touchscreen 51 on one side of the grip part 33, on the top of the plate 29, said touchscreen being connected to the electrical controller 51 and it being possible to manually input data by means of said touchscreen and it being possible to display data on said touchscreen.

Furthermore, said alignment device 26 has, on the other side of the grip part 33, on the bottom of the plate 29, measuring means 52 for measuring a movement path of the alignment device 26, which is supported on the table 4, relative to the table 4. These measuring means can have a wheel which runs on the table 4 and of which the rotary movement is a reference for the distance covered by means of the alignment device 26. Furthermore, the alignment device 26 has, in the region of the plate 29, on that side of said plate which is averted from the touchscreen 51, a measuring means 53 for ascertaining a force which acts on said measuring means. When the alignment device 26 is placed against the stack 28 by way of the plate 31, said stack acts on the measuring means 53 which project somewhat beyond the surface 32, and therefore said measuring means can absorb the force with which the stack presses against the measuring means 53.

The described cutting system 25 permits an extremely wide variety of modifications, in particular in respect of the alignment device 26 and actuation of the cutting machine 1 by means of the alignment device 26 or actuation of the alignment device 26 by means of the cutting machine 1.

By way of example, the alignment device 26 can also have operator control elements which effect the function of the foot pedal 24 for executing the cutting indication by lowering the pressing bar 7 into a position slightly above the stack 28 which is to be cut. It is therefore not necessary for the operator to operate the foot pedal 24. It is therefore possible to effect said function by operating one or more operator control elements of the alignment device 26, without looking away from the region of interest of the stack 28. The function of the changing pressing pressure of the pressing bar 7 can also be integrated into the alignment device 26.

That which is claimed is:

1. A cutting system comprising:

a cutting machine for cutting sheet-like, stacked material; and an alignment device, which is mechanically decoupled from the cutting machine and configured to be manually manipulated for manually laterally aligning the sheet-like, stacked material on a flat surface of the alignment device after a cutting process and before a next cutting process;

wherein the alignment device is movably placed on a table of the cutting machine, which table serves to receive the sheet-like, stacked material;

wherein the cutting machine has an electrical machine controller for controlling functions of the cutting machine;

wherein the alignment device has electrical components, and the electrical machine controller of the cutting machine is configured to be actuated by means of the alignment device;

wherein the electrical components of the alignment device are at least one of operator control elements and indicators which are associated with the electrical machine controller of the cutting machine;

wherein defined functions of the cutting machine are configured to be activated by means of the operator control elements of the alignment device; and wherein a backgauge of the cutting machine for feeding the sheet-like, stacked material to be cut in the direction of a cutting plane of the cutting machine is actuated by means of one or more of the operator control elements of the alignment device for moving the backgauge perpendicular to the cutting plane, rotating the backgauge about a vertical axis or tilting the backgauge about a horizontal axis.

2. The cutting system as claimed in claim 1, wherein the electrical machine controller of the cutting machine is configured to be actuated in a wireless manner by means of the alignment device.

3. The cutting system as claimed in claim 1, wherein the cutting machine has at least one of operator control elements and indicators which are associated with the electrical machine controller of the cutting machine.

4. The cutting system as claimed in claim 3, wherein the at least one of the operator control elements and the indicators of at least one of the cutting machine and the alignment device are integrated into a touchscreen display.

5. The cutting system as claimed in claim 1, wherein the cutting machine has a transmitter and a receiver which are associated with the electrical machine controller of the cutting machine, and the alignment device has a transmitter and a receiver which are associated with the electrical components of the alignment device, and wherein firstly the transmitter of the cutting machine and the receiver of the alignment device interact, and secondly the transmitter of the alignment device and the receiver of the cutting machine interact.

6. The cutting system as claimed in claim 5, wherein a display of the alignment device is connected to the receiver of the alignment device.

7. The cutting system as claimed in claim 6, wherein the electrical components of the alignment device are in the form of a keypad, a touchscreen, a connection for a mobile data memory, or a scanning device.

8. The cutting system as claimed in claim 7, wherein data which is input or read-in by means of the electrical components of the alignment device is displayed on the display of the alignment device or is transmitted in a wireless manner to the electrical machine controller of the cutting machine.

9. The cutting system as claimed in claim 1, wherein the alignment device is provided with an electronic access barrier and wherein activation of at least one electrical function of the alignment device is blocked by means of the access barrier.

10. The cutting system as claimed in claim 1, wherein a pressing bar of the cutting machine serves to clamp the sheet-like, stacked material between the pressing bar and the table and is moved by actuation into a cutting indication position or is set in respect of a pressing pressure of the pressing bar by means of one or more of the operator control elements of the alignment device.

11. The cutting system as claimed in claim 1, wherein measuring means are integrated into the alignment device for measuring a movement path of the alignment device relative to the table, or for measuring a horizontal distance of the alignment device from a region of the cutting machine.

12. A cutting system comprising:

a cutting machine for cutting sheet-like, stacked material; and an alignment device, which is mechanically decoupled from the cutting machine and configured to be manually manipulated for manually laterally aligning the sheet-like, stacked material on a flat surface of the alignment device after a cutting process and before a next cutting process;

wherein the alignment device is movably placed on a table of the cutting machine, which table serves to receive the sheet-like, stacked material;

wherein the cutting machine has an electrical machine controller for controlling functions of the cutting machine;

wherein the alignment device has electrical components, and the electrical machine controller of the cutting machine is configured to be actuated by means of the alignment device;

wherein the electrical components of the alignment device are at least one of operator control elements and indicators which are associated with the electrical machine controller of the cutting machine;

wherein defined functions of the cutting machine are configured to be activated by means of the operator control elements of the alignment device; and wherein the alignment device has a first part with a lower flat surface, a second part which is arranged perpendicular to said first part and has a flat surface which is arranged perpendicular to the lower flat surface of the first part, and a third part which connects the first part and the second part, wherein the third part has a grip recess for manually grasping the alignment device, and wherein the lower flat surface of the first part and the flat surface of the second part are arranged at a right angle in relation to one another.

13. The cutting system as claimed in claim 12, wherein one or more of the operator control elements are arranged in the region of the third part.

14. The cutting system as claimed in claim 12, wherein the electrical machine controller of the cutting machine is configured to be actuated in a wireless manner by means of the alignment device.

15. The cutting system as claimed in claim 12, wherein the cutting machine has at least one of operator control elements and indicators which are associated with the electrical machine controller of the cutting machine.

16. The cutting system as claimed in claim 15, wherein the at least one of the operator control elements and the indicators of at least one of the cutting machine and the alignment device are integrated into a touchscreen display.

17. The cutting system as claimed in claim 12, wherein the cutting machine has a transmitter and a receiver associated with the electrical machine controller of the cutting machine, and the alignment device has a transmitter and a receiver associated with the electrical components of the alignment device, and wherein the transmitter of the cutting machine and the receiver of the alignment device interact and the transmitter of the alignment device and the receiver of the cutting machine interact.

18. The cutting system as claimed in claim 17, wherein a display of the alignment device is connected to the receiver of the alignment device.

19. The cutting system as claimed in claim 18, wherein the electrical components of the alignment device are in the form of a keypad, a touchscreen, a connection for a mobile data memory, or a scanning device.

20. The cutting system as claimed in claim 19, wherein data which is input or read-in by means of the electrical components of the alignment device is displayed on the display of the alignment device or is transmitted in a wireless manner to the electrical machine controller of the cutting machine.

21. The cutting system as claimed in claim 12, wherein the alignment device is provided with an electronic access barrier and wherein activation of at least one electrical function of the alignment device is blocked by means of the access barrier.

22. The cutting system as claimed in claim 12, wherein a pressing bar of the cutting machine serves to clamp the sheet-like, stacked material between the pressing bar and the table and is moved by actuation into a cutting indication position or is set in respect of a pressing pressure of the pressing bar by means of one or more of the operator control elements of the alignment device.

23. The cutting system as claimed in claim 12, wherein measuring means are integrated into the alignment device for measuring a movement path of the alignment device relative to the table, or for measuring a horizontal distance of the alignment device from a region of the cutting machine.

* * * * *